US009861194B1

(12) United States Patent
Park

(10) Patent No.: US 9,861,194 B1
(45) Date of Patent: Jan. 9, 2018

(54) SAFE CHEST OF DRAWERS

(71) Applicant: Heejun Park, Seoul (KR)

(72) Inventor: Heejun Park, Seoul (KR)

( * ) Notice: Subject to any disclaimer, the term of this patent is extended or adjusted under 35 U.S.C. 154(b) by 0 days.

(21) Appl. No.: 15/594,005

(22) Filed: May 12, 2017

(30) Foreign Application Priority Data

Aug. 29, 2016 (KR) ..... 10-2016-0109930

(51) Int. Cl.

| | |
|---|---|
| ***A47B 67/04*** | (2006.01) |
| ***A47B 97/00*** | (2006.01) |
| ***A47B 88/57*** | (2017.01) |
| ***A47B 88/473*** | (2017.01) |

(52) U.S. Cl.
CPC ..... *A47B 67/04* (2013.01); *A47B 88/473* (2017.01); *A47B 88/57* (2017.01); *A47B 97/00* (2013.01); *A47B 2097/008* (2013.01)

(58) Field of Classification Search
CPC ..... A47B 2097/008; A47B 97/00; A47B 2210/0091; A47B 88/473; A47B 88/477; A47B 88/70; A47B 88/50; A47B 88/53; A47B 88/57; A47B 67/04; A47B 88/467; A47B 2210/16; A47L 15/427; E05B 65/463; E05B 65/464; E05B 65/465; E05B 64/466; E05B 64/468
USPC ..... 312/317.1
See application file for complete search history.

(56) References Cited

U.S. PATENT DOCUMENTS

| | | | | | |
|---|---|---|---|---|---|
| 1,238,514 | A * | 8/1917 | Hartbeck | ..... | E05B 65/466 109/47 |
| 1,241,093 | A * | 9/1917 | Collings | ..... | A47B 88/467 109/47 |
| 3,674,360 | A * | 7/1972 | Ratner | ..... | E05B 65/46 312/215 |

FOREIGN PATENT DOCUMENTS

| | | | | | |
|---|---|---|---|---|---|
| DE | 10201242 | A1 * | 7/2003 | ..... | A47B 88/467 |
| JP | H03-016997 | U | 2/1991 | | |
| JP | H11-103959 | A | 4/1999 | | |
| JP | 2001-314257 | A | 11/2001 | | |
| JP | 2002-142887 | A | 5/2002 | | |
| KR | 10-2015-0089210 | A | 8/2015 | | |
| KR | 10-2015-0134190 | A | 12/2015 | | |
| WO | WO-2007032686 | A1 * | 3/2007 | ..... | A47B 96/025 |

* cited by examiner

*Primary Examiner* — Andrew M Roserma
(74) *Attorney, Agent, or Firm* — Korus Patent, LLC; Seong Il Jeong

(57) ABSTRACT

A safe chest of drawers includes a chest body, one or more drawers, a sliding bar, a spring box assembly, a sliding brake assembly and one or more drawer mounting assemblies. The chest body includes a drawer accommodation part and a leg part. The drawers are inserted into the drawer accommodation part, and are selectively opened and closed. The sliding bar performs sliding movement in forward and backward directions, and is coupled to a pair of movable casters. The spring box assembly is configured such that it has a protrusion structure including a plurality of unidirectional protrusions configured to restrict backward sliding movement. The sliding brake assembly is disposed over the spring box assembly, and has a brake member. The one or more drawer mounting assemblies function to implement forward sliding by pushing the sliding bar.

5 Claims, 6 Drawing Sheets

SAFE CHEST OF DRAWERS

BACKGROUND

1. Technical Field

The present invention relates generally to a safe chest of drawers, and more particularly to a safe chest of drawers that is capable of preventing itself from falling forward due to the action of force applied to a drawer when an infant or a child climbs aboard the drawer or holds the drawer as if he or she is doing a chin-up in the state in which the drawer has been opened.

2. Description of the Related Art

Generally, a chest of drawers includes drawers configured to accommodate clothes, etc., and has a structure of multiple rows of drawers.

Such chests of drawers having a structure of multiple rows of drawers enable clothes, miscellaneous items, etc. to be easily accommodated in, stored in, and taken out of drawers, and, thus, are widely used in homes where infants or children are raised.

Meanwhile, chests of drawers having a structure of multiple rows of drawers that are widely used in homes are configured such that an infant or a child can easily open the drawers thereof. Accordingly, there are many cases where a curious infant or child climbs aboard the drawer or holds the drawer as if he or she is doing a chin-up in the state in which the drawer has been opened. In these cases, a problem occurs in that a chest of drawers falls forward due to the action of force applied to a drawer.

As a result, a problem occurs in that a safety-related accident, such as an accident in which an infant or a child is crushed or otherwise injured by a falling chest of drawers, occurs frequently.

Meanwhile, among prior art documents related to conventional chests of drawers, Korean Patent Application Publication No. 10-2015-0134190 discloses a chest of drawers including: a frame-shaped frame; a cover part configured to surround the frame; and an accommodation part slidably provided in the frame and configured to have a space in which items can be accommodated; wherein the cover part includes: a first cover part formed in a sideways "U" sectional shape and configured to cover three surfaces of the remaining surfaces of the frame other than the front and bottom surfaces of the frame; and a second cover part configured to cover the front and bottom surfaces of the frame and one surface of the frame other than the surfaces covered by the first cover part. Korean Patent Application Publication No. 10-2015-0089210 discloses a safety locking device against an infant for a chest of drawers including a safety locking unit, the safety locking unit comprises: a guide bar fitted into the elongated hole of a partition front plate to move along the elongated hole; a stopper mounted on the front end surface of the guide bar, disposed to move along the elongated hole along with the guide bar, and configured such that the lower end thereof is superimposed on the front surface of the upper end portion of a drawer or sliding door and thus prevents the drawer or sliding door from being opened forward; and a weight mounted at the back end of the guide bar, and configured to prevent the guide bar from being removed from the elongated hole and keep weight balance in connection with the stopper.

SUMMARY

The present invention has been conceived to overcome the above-described problems, and an object of the present invention is to provide a safe chest of drawers that is capable of preventing itself from falling forward due to the action of force applied to a drawer when an infant or a child climbs aboard the drawer or holds the drawer as if he or she is doing a chin-up in the state in which the drawer has been opened and that is also capable of preventing safety-related accidents.

An object of the present invention is to provide a safe chest of drawers that is configured to include a safety device that, when a drawer accommodated in the chest of drawers is opened by pulling it forward, pushes a sliding bar to thus enable the safety device to be disposed forward along with the sliding bar and to thus generate support force against a support surface in front of the chest of drawers, thereby preventing itself from falling forward when an infant or a child climbs aboard a drawer or holds a drawer as if he or she is doing a chin-up in the state in which the drawer has been opened.

According to an aspect of the present invention, there is provided a safe chest of drawers, including: a chest body including a drawer accommodation part configured to have a drawer support wall, including openings, on one side of an interior of the drawer accommodation part, and also including a leg part coupled to both side ends of a bottom surface of the drawer accommodation part; one or more drawers configured to be inserted into and supported in the drawer accommodation part and to be selectively opened and closed in a forward or backward direction; a sliding bar disposed on one side of the interior of the drawer accommodation part to perform sliding movement in forward and backward directions, disposed such that the lower end thereof passes through the bottom surface of the drawer accommodation part, and coupled to a pair of movable casters that come into contact with a support surface; a spring box assembly fixedly disposed on the bottom surface of one side of the interior of the drawer accommodation part, and configured such that it has a protrusion structure including a plurality of unidirectional protrusions configured to restrict backward sliding movement and such that the protrusion structure is disposed to be exposed upward; a sliding brake means disposed over the spring box assembly in the state of being fixedly coupled to the sliding bar, and configured to have a brake member which comes into contact with a top surface of the protrusion portion and which allows forward movement and restricts backward movement; and one or more drawer mounting means fastened to the back surfaces of one side of the drawers, and configured to function to implement forward sliding by pushing the sliding bar when each of the drawers is opened and moved forward.

The sliding bar: may have an "L"-shaped bent structure, including a vertical bar located on a back side of the drawer accommodation part and disposed vertically and a lateral bar configured to extend from the lower end of the vertical bar and disposed laterally in a forward direction; may be supported by and coupled to an upper guide fastened to an upper portion of the drawer accommodation part 111 and a lower guide fastened to an upper portion of the leg part so that the sliding bar can slide in forward and backward directions; and may be coupled to the pair of movable casters that are located at the front end of the lateral bar and come into contact with the support surface, thereby generating support force against the support surface.

The spring box assembly may include: a spring box fixedly disposed on the bottom surface of one side of the interior of the drawer accommodation part, and formed in the shape of a square pipe with an opening formed along the center of the top surface thereof in the lengthwise direction thereof; a leaf spring inserted into and disposed in the spring box, and formed to have a bent structure to generate elastic force in a vertical direction; a movement restricting protrusion formation member inserted into and caught in the spring box to be located on the leaf spring, and configured such that it has a protrusion portion, including a plurality of unidirectional protrusions, in an upper portion of the movement restricting protrusion formation member, and such that the protrusion portion is exposed above the spring box via the opening; a pair of box caps fitted into both side ends of the spring box in the lengthwise direction thereof; and a fastening pin inserted through a side surface of the spring box, and configured to support and fasten the leaf spring that is inserted into the spring box.

The sliding brake means may include: a fastening block fixedly coupled to the inside surface of the sliding bar, and configured to have a downwardly open hollow structure; a spring inserted into and disposed in the hollow hole of the fastening block; and a brake member inserted into the fastening block, and disposed such that the lower portion thereof is exposed downward, such that it is elastically supported by the spring, and such that the lower end thereof comes into contact with the top surface of the protrusion portion of the movement restricting protrusion formation member.

Each of the drawer mounting means may include: a drawer fastening block fastened to the back surface of one side of a corresponding one of the drawers, located outside the drawer support wall via the openings of the drawer support wall not to interfere with forward and backward movement, and configured to have spring mounting holes; a rubber plate fastened to the drawer fastening block to be located in front of the drawer fastening block, and provided to perform a shock absorbing action; and springs inserted into the spring mounting holes of the drawer fastening block, and configured to elastically support the rubber plate and thus enhance the shock absorbing action.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
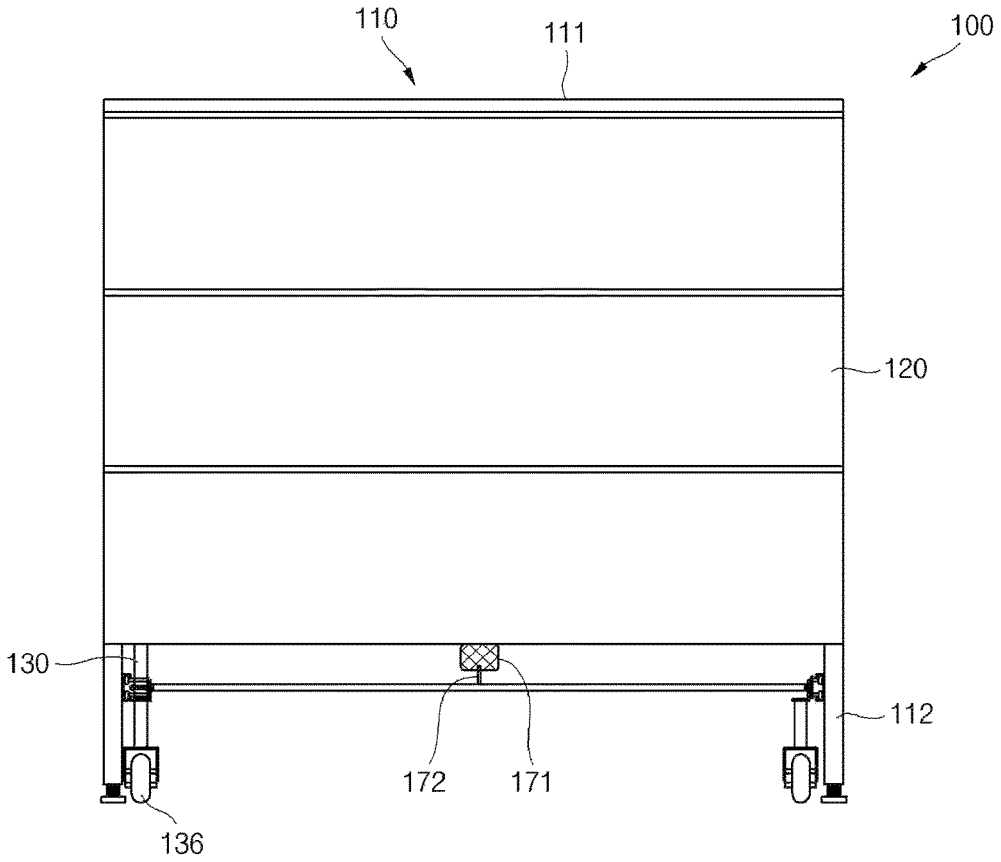
FIG. 1 is a front view showing the configuration of a safe chest of drawers according to an embodiment of the present invention.
Figure 2:
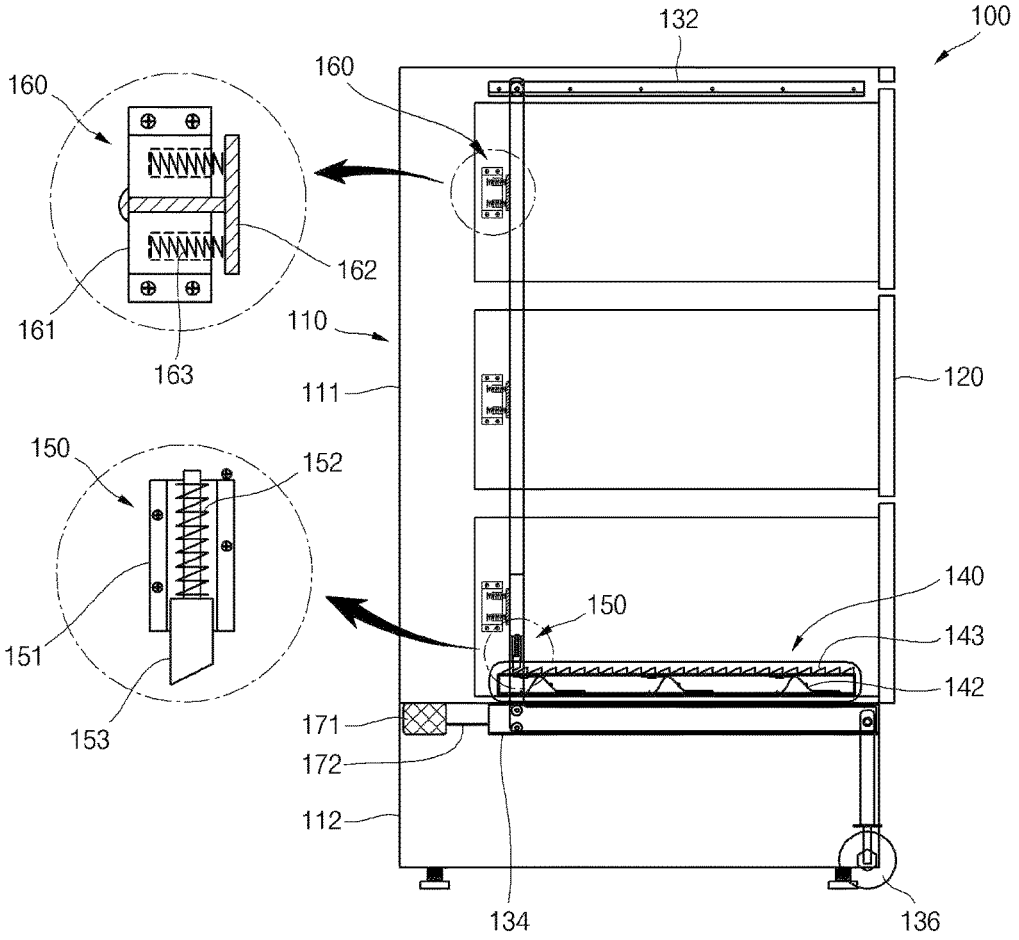
FIG. 2 is a side sectional view showing the configuration of the safe chest of drawers according to the embodiment of the present invention.
Figure 3:
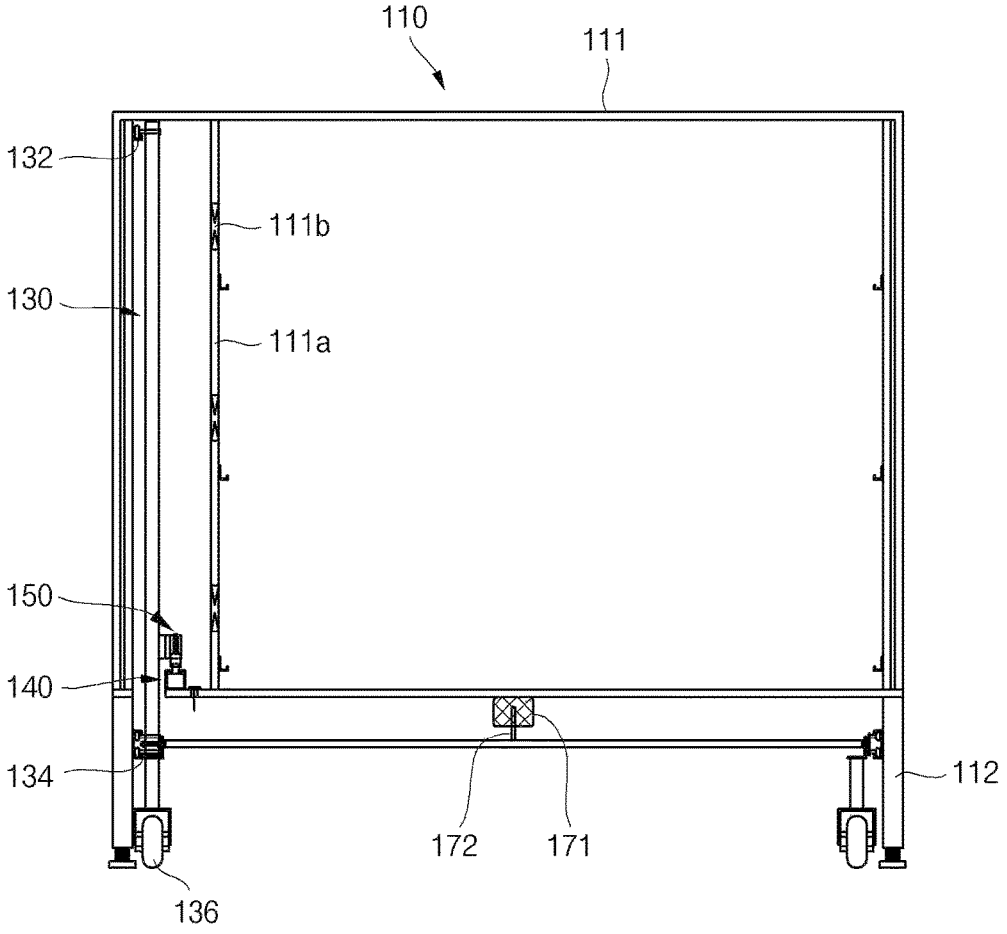
FIG. 3 is a view showing the configurations of the important parts of the safe chest of drawers according to the embodiment of the present invention.
Figure 4:
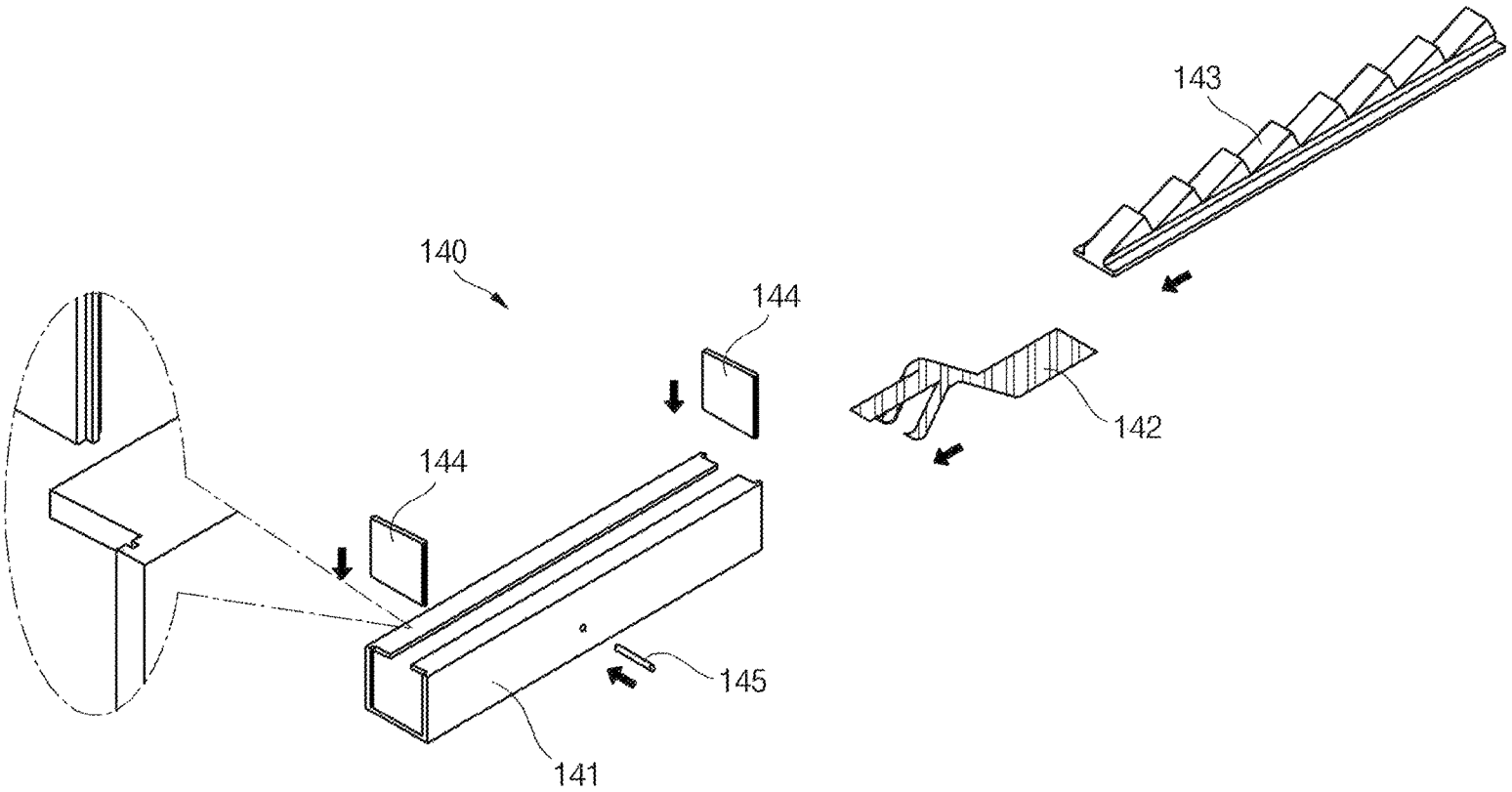
FIG. 4 is an exploded perspective view showing the spring box assembly of the safe chest of drawers according to the embodiment of the present invention.
Figure 5:
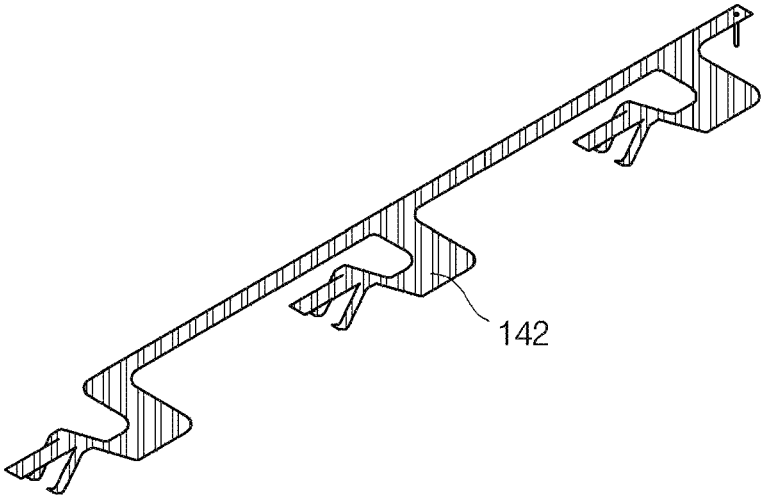
FIG. 5 is a perspective view showing another example of the leaf spring of a spring box assembly according to an embodiment of the present invention.

Preferred embodiments of the present invention will be described with reference to the attached drawings below. Via this detailed description, the object and configuration of the present invention and features based on the objects and the configuration will be more fully understood.

As shown in FIGS. 1 to 6, a safe chest of drawers 100 according to an embodiment of the present invention includes a chest body 110, one or more drawers 120, a sliding bar 130, a spring box assembly 140, a sliding brake means 150, and one or more drawer mounting means 160.

The chest body 110 includes: a hexahedral box-shaped drawer accommodation part 111 configured to have a structure the front surface of which is open such that the drawers 120 can be accommodated therein and can be selectively opened and closed; and a leg part 112 connected to and provided at the ends of both sides of the bottom surface of the drawer accommodation part 111.

In this case, the chest body 110 includes a drawer support wall 111*a* on one side of the interior of the chest body 110. The drawer support wall 111*a* preferably has openings 111*b*. The drawer support wall 111*a* is formed to correspond to the number of drawers 120 and to be located on one side of the drawers 120 that are accommodated and supported in the chest body 110.

In this case, in the drawer accommodation part 111, well-known rail-type drawer supports are located on the inside surface of the drawer support wall 111*a* and its opposite surface, and facilitate the accommodation, support and forward and backward sliding movement of the drawers 120.

In this case, an opening is formed through one side of the bottom surface of the drawer accommodation part 111 so that the sliding bar 130 can be disposed to pass through the drawer accommodation part 111 and can slide in forward and backward directions.

In this case, the leg part 112 functions to locate the drawer accommodation part 111 at a predetermined height above a support surface and to support the drawer accommodation part 111.

The drawers 120 include one or more drawers that are inserted into and supported in the drawer accommodation part 111. The drawers 120 are disposed to be selectively opened and closed in a forward or backward direction.

In this case, the drawers 120 are configured to cover the open front surface of the drawer accommodation part 111. The drawers 120 may be accommodated and supported in the drawer accommodation part 111 by using the drawer support wall 111*a* that is disposed on one side of the drawer body 110 configured to enable clothes, etc. to be accommodated.

The sliding bar 130 is disposed on one side of the interior of the drawer accommodation part 111 of the chest body 110, and is configured to slide in forward and backward directions. The lower end of the sliding bar 130 is disposed to pass through the bottom surface of the drawer accommodation part 111, and is coupled to a pair of movable casters 136 that come into contact with the support surface.

In this case, the sliding bar 130 is preferably configured to have an "L"-shaped bent structure, including a vertical bar located on the back side of the drawer accommodation part 111 and disposed vertically and a lateral bar configured to extend from the lower end of the vertical bar and disposed laterally in a forward direction.

In this case, the sliding bar 130 is supported by and coupled to an upper guide 132 fastened to the upper portion of the drawer accommodation part 111 and a lower guide 134 fastened to the upper portion of the leg part 112 so that the sliding bar can slide in forward and backward directions. The sliding bar 130 is coupled to the pair of movable casters 136 that are located at the front end of the lateral bar and come into contact with the support surface. Accordingly, the sliding bar 130 functions to slide in forward and backward directions and to generate support force based on contact with the support surface.

In this case, the movable casters 136 are connected by a connection member 138, and are located on both sides of the interior of the leg part 112.

The spring box assembly 140 is a component configured to control the sliding movement of the sliding bar 130 in forward and backward directions, and is connected to the sliding brake means 150. The spring box assembly 140 is fastened to the bottom surface of one side of the interior of the drawer accommodation part 111.

In this case, the spring box assembly 140 has a protrusion structure including a plurality of unidirectional protrusions configured to restrict the backward sliding movement of the sliding bar 130. The protrusion structure is disposed to be exposed upward.

More specifically, the spring box assembly 140 is preferably configured to include: a spring box 141 fixedly disposed on the bottom surface of one side of the interior of the drawer accommodation part 111, laterally disposed in the front-back direction of the drawer accommodation part 111, and formed in the shape of a square pipe with an opening formed along the center of the top surface thereof in the lengthwise direction thereof; a leaf spring 142 inserted into and disposed in the spring box 141, and formed to have a bent structure to generate elastic force in a vertical direction; a movement restricting protrusion formation member 143 inserted into and caught in the spring box 141 to be located on the leaf spring 142, and configured such that it has a protrusion portion, including a plurality of unidirectional protrusions, in the upper portion of the movement restricting protrusion formation member 143 and such that the protrusion portion is exposed above the spring box 141 via the opening; a pair of box caps 144 fitted into both side ends of the spring box 141 in the lengthwise direction thereof; and a fastening pin 145 inserted through the side surface of the spring box 141, and configured to support and fasten the leaf spring 142 that is inserted into the spring box 141.

In this case, the spring box 141 and the box caps 144 form a male-female coupling structure including a depression and a protrusion in their coupling portions, and thus the box caps 144 and the spring box 141 are coupled to each other by inserting the box caps 144 into the spring box 141.

The sliding brake means 150 is connected to the spring box assembly 140. The sliding brake means 150 is disposed over the spring box assembly 140 in the state of being fixedly coupled to the sliding bar 130. The sliding brake means 150 has a brake member which comes into contact with the top surface of the protrusion portion of the movement restricting protrusion formation member 143 and which allows the forward movement of the sliding bar 130 and restricts the backward movement thereof.

In this case, the sliding brake means 150 is preferably configured to include: a fastening block 151 fixedly coupled to the inside surface of the sliding bar 130, and configured to have a downwardly open hollow structure; a spring 152 inserted into the hollow of the fastening block 151; and a brake member 153 inserted into the fastening block 151, and disposed such that the lower portion thereof is exposed downward, such that it is elastically supported by the spring 152, and such that the lower end thereof comes into contact with the top surface of the protrusion portion of the movement restricting protrusion formation member 143 of the spring box assembly 140.

In this case, the brake member 153 is preferably configured to: a spring holder portion put into the spring 152 that is inserted into the fastening block 151; and a stop protrusion portion formed to extend from the lower end of the spring holder portion in an integrated manner, disposed such that part thereof is exposed below the fastening block 151, and configured to have a bottom surface structure corresponding to the structure of an unidirectional protrusion of the movement restricting protrusion formation member 143.

The drawer mounting means 160 are fastened to the back surfaces of one side of the drawers 120, and function to implement forward sliding by pushing the sliding bar 130 when each of the drawers 120 is opened and moved forward.

In this case, the drawer mounting means 160 are mounted to be located on one side surfaces of the drawers 120. The drawer mounting means 160 are mounted via the openings 111*b* formed in the drawer support wall 111*a* so that they are located inside the drawer accommodation part 111 and are also located outside the drawer support wall 111*a*.

More specifically, each of the drawer mounting means 160 is preferably configured to include: a drawer fastening block 161 fastened to the back surface of one side of a corresponding one of the drawers 120, located outside the drawer support wall 111*a* via the openings 111*b* not to interfere with forward and backward movement, and configured to have spring mounting holes; a rubber plate 162 fastened to the drawer fastening block 161 to be located in front of the drawer fastening block 161, and provided to perform a shock absorbing action; and springs 163 inserted into the spring mounting holes of the drawer fastening block 161, and provided to elastically support the rubber plate 162 and thus enhance the shock absorbing action.

In this case, each of the drawer mounting means 160 is provided for each of the drawers 120.

Furthermore, the sliding bar 130 is preferably connected to a wire 172 wound in a clockwork box 171 to thus restrict moving speed to some extent during forward sliding movement and perform a shock absorbing action.

In this case, the clockwork box 171 is fastened to the back side of the central portion of the bottom surface of the drawer accommodation part 111 of the chest body 110, as shown in the drawings, and may be configured to connect the wire 172 to the connection member 138 that connects the pair of movable casters 136 to each other.

Figure 6:
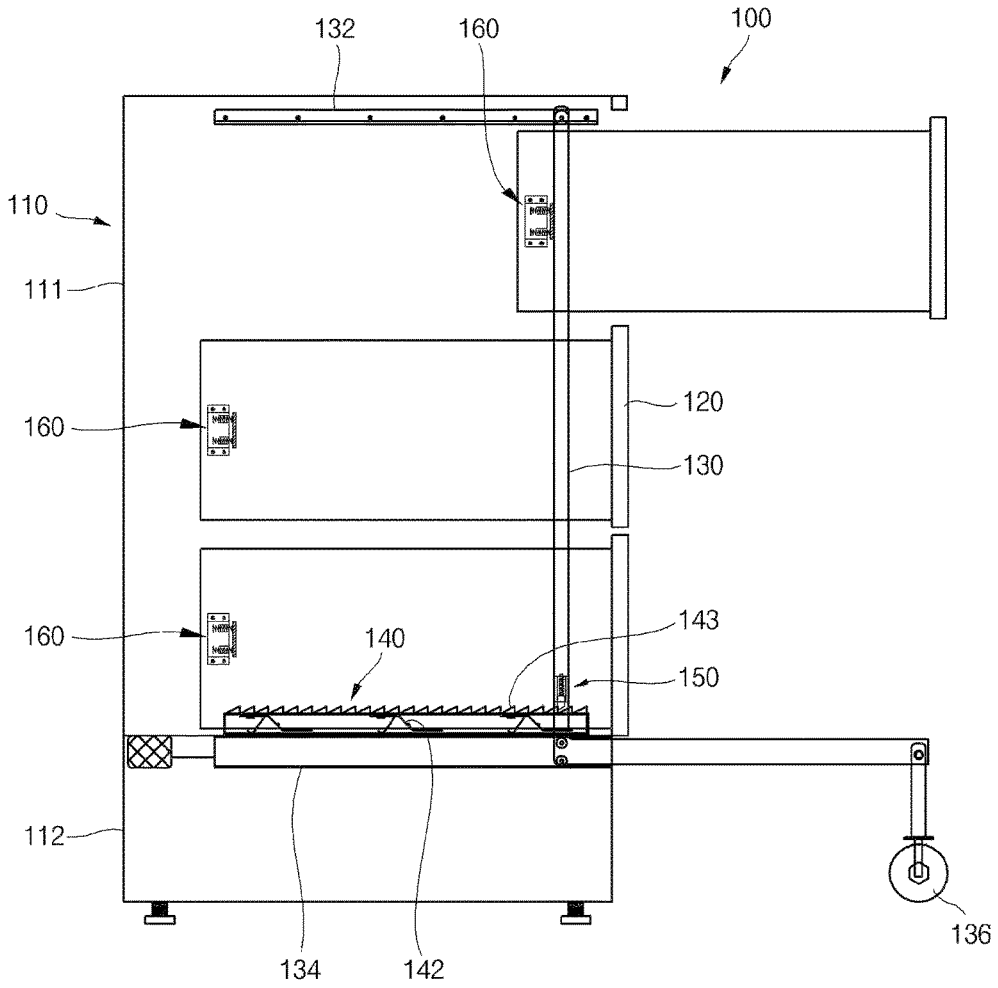
FIG. 6 is a side sectional view showing the operating state of the safe chest of drawers according to the embodiment of the present invention.

According to the safe chest of drawers 100 of the present invention, which is configured as described above, when any one of the drawers 120 is opened by pulling it forward, as shown in FIG. 6, in the state in which the drawers 120 have been accommodated and supported in the drawer accommodation part 111 of the chest body 110, the drawer mounting means 160 mounted on one side surface of the drawer 120 implements the forward sliding of the sliding bar 130 by pushing the sliding bar 130 disposed on the one side of the interior of the drawer accommodation part 111.

In this case, the rubber plate 162 elastically supported by the springs 163 is disposed in the front portion of the drawer mounting means 160. When the drawer 120 is moved forward to open it, the rubber plate 162 comes into contact with the sliding bar 130, and pushes the sliding bar 130 forward while performing a shock absorbing function.

In this case, the sliding bar 130 performs stable sliding movement via the upper guide 132 and the lower guide 134, and performs more stable sliding movement via the pair of movable casters 136 that come into contact with a support surface and generate support force.

Furthermore, the sliding bar 130 is pushed by the drawer mounting means 160, and thus performs forward sliding movement. At this time, the sliding brake means 150 configured to generate elastic force in a vertical direction comes into contact with the upper portion of the spring box assembly 140 having elastic force, and performs forward movement along the upper portion of the spring box assembly 140 along with the sliding bar 130. This can provide stable operation by attenuating moving speed when the drawer 120 is opened by pulling it forward, and can prevent the side effect in which the drawer 120 is rapidly moved to the outside.

In this case, the brake member 153 elastically supported by the spring 512 is moved in the state of being in contact with the protrusion portion of the movement restricting protrusion formation member 143 elastically supported by the leaf spring 142 in the spring box 141 of the spring box assembly 140, and thus the sliding brake means 150 performs control so that the sliding bar 130 is moved forward at an attenuated moving speed.

Furthermore, the brake member 153 of the sliding brake means 150 and the protrusion portion of the movement restricting protrusion formation member 143 of the spring box assembly 140 have corresponding unidirectional structures, and thus an advantage is provided in that forward movement is facilitated and backward movement is restricted by the stop protrusion.

Furthermore, the wire 172 wound in the clockwork box 171 is connected to the pair of movable casters 136. When the drawer 120 is opened by pulling it forward, the drawer 120 and the sliding bar 130 are not rapidly moved forward, but is gradually moved forward, thereby further enhancing safety.

According to the above-described operation, when each of the drawers 120 is opened by pulling it forward, the sliding bar 130 having an "L"-shaped bent structure is also moved forward along with the drawer 120 and is thus located in front of the chest body 110. Accordingly, the pair of movable casters 136 connected to the front end of the sliding bar 130 come into a support surface at a location in front of the chest body 110, and provide support force against the support surface.

In other words, according to the present invention, when each of the drawers 120 is opened by pulling it forward, the sliding bar 130 is moved forward as the same time that the drawer 120 is moved forward, and thus the pair of movable casters 136 are enabled to protrude in front of the chest body 110. Accordingly, advantages are provided such that support force against a support surface is provided to the lower portion of the chest body 110 and a support function is provided.

As a result, according to the present invention, even when an infant or a child climbs aboard one of the drawers 120 or holds one of the drawers 120 as if he or she is doing a chin-up in the state in which the drawer 120 has been opened and thus force acting forward is applied to the drawer 120, the sliding bar 130 having an "L"-shaped bent structure and the pair of movable casters 136 connected to the sliding bar 130 moved forward in front of the chest body 110 come into contact with a support surface and function as a support in the bottom portion of the chest body 110, thereby preventing the chest of drawers 100 from falling forward and also preventing safety-related accidents.

According to the present invention, the chest of drawers 100 can be very effectively prevented from falling forward due to the mischief of an infant or a child, and safety-related accident attributable to the user of the chest of drawers 100 can be prevented.

According to the present invention, a structure including safety devices, such as the spring box assembly 140, the sliding brake means 150, etc., can be provided, and thus the safety of the use of the chest of drawers 100 can be further enhanced.

While the present invention has been described in conjunction with the specific embodiments above, the present invention is not limited to the disclosed embodiments and the accompanying drawings, and it will be apparent to those skilled in the art that various modifications and alterations may be made without departing from the technical spirit of the present invention.

What is claimed is:

1. A safe chest of drawers, comprising:

a chest body including:

a drawer accommodation part having a drawer support wall on one side of an interior thereof, the drawer support wall including openings; and a leg part coupled to both side ends of a bottom surface of the drawer accommodation part and configured to contact a support surface of the safe chest of drawers;

one or more drawers inserted into and supported in the drawer accommodation part to be selectively opened and closed in a forward and a backward direction, respectively, each of the one of more drawers comprising a drawer mounting assembly fastened to a back surface of one side of said drawer;

a sliding bar disposed on the one side of the interior of the drawer accommodation part to perform sliding movement in the forward and backward directions, the sliding bar disposed such that a lower end thereof passes through the bottom surface of the drawer accommodation part, and the lower end of the sliding bar is coupled to a pair of movable casters that come into contact with the support surface of the safe chest of drawers;

a spring box assembly fixedly disposed on a bottom of the interior of the drawer accommodation part at the sliding bar, the spring box assembly having a protrusion structure including a plurality of unidirectional protrusions configured to restrict backward sliding movement of the one or more drawers and the sliding bar, and the protrusion structure is disposed to be exposed upward;

a sliding brake assembly disposed over the spring box assembly and fixedly coupled to the sliding bar, the sliding brake assembly having a brake member which comes into contact with the plurality of unidirectional protrusions to allow forward sliding movement of the one or more drawers and the sliding bar and restrict the backward sliding movement of the one or more drawers and the sliding bar; and each of the drawer mounting assemblies configured to implement the forward sliding movement of the sliding bar by pushing the sliding bar when the drawer on which said drawer mounting assembly is fastened is opened and moved forward, and thereby moves the brake member along the plurality of unidirectional protrusions.

2. The safe chest of drawers of claim 1, wherein the sliding bar:

has an "L"-shaped bent structure, including:

a vertical bar located at a back side of the drawer accommodation part and disposed vertically; and a lateral bar configured to extend from a lower end of the vertical bar and disposed laterally in the forward direction;

is supported by and coupled to an upper guide fastened to an upper portion of the drawer accommodation part and a lower guide fastened to an upper portion of the leg part so that the sliding bar can slide in the forward and backward directions; and is coupled to the pair of movable casters that are located at a front end of the lateral bar and come into contact with the support surface of the safe chest of drawers, thereby generating support force against the support surface of the safe chest of drawers.

3. The safe chest of drawers of claim 1, wherein the spring box assembly comprises:

a spring box fixedly disposed on the bottom of the interior of the drawer accommodation part, and formed in a shape of a square pipe with an opening formed along a center of a top surface thereof in a lengthwise direction thereof;

a leaf spring inserted into and disposed in the spring box, and formed to have a bent structure to generate elastic force in a vertical direction;

a movement restricting protrusion formation member inserted into and caught in the spring box to be located on the leaf spring, and the movement restricting portion has the protrusion structure, including the plurality of unidirectional protrusions, in an upper portion of the movement restricting protrusion formation member, and such that the plurality of unidirectional protrusions are exposed above the spring box via the opening of the spring box;

a pair of box caps fitted into both side ends of the spring box in the lengthwise direction thereof; and a fastening pin inserted through a side surface of the spring box, and configured to support and fasten the leaf spring that is inserted into the spring box.

4. The safe chest of drawers of claim 1, wherein the sliding brake assembly comprises:

a fastening block fixedly coupled to an inside surface of the sliding bar, and configured to have a downwardly open hollow structure;

a spring inserted into and disposed in a hollow hole of the fastening block; and the brake member inserted into the fastening block, and disposed such that a lower portion thereof is exposed downward, such that the brake member is elastically supported by the spring, and such that a lower end of the lower portion thereof comes into contact with the plurality of unidirectional protrusions.

5. The safe chest of drawers of claim 1, wherein each of the drawer mounting assemblies comprises:

a drawer fastening block fastened to the back surface of the one side of a corresponding one of the one or more drawers, the drawer fastening block located outside the drawer support wall via the openings of the drawer support wall, so as to not to interfere with forward and backward movement, and having spring mounting holes;

a rubber plate fastened to the drawer fastening block to be located in front of the drawer fastening block, and provided to perform a shock absorbing action against the sliding bar; and springs inserted into the spring mounting holes of the drawer fastening block, and configured to elastically support the rubber plate and thus enhance the shock absorbing action.

* * * * *